United States Patent [19]

van den Haak

[11] Patent Number: 4,995,326

[45] Date of Patent: Feb. 26, 1991

[54] ANCHOR WITH CROSS CONNECTION

[76] Inventor: Rob van den Haak, Meerkoetstraat 83a, 2920 AC Krimpen a/d Ijssel, Netherlands

[21] Appl. No.: 444,743

[22] Filed: Nov. 30, 1989

[30] Foreign Application Priority Data

Dec. 2, 1988 [NL] Netherlands ..... 8802975

[51] Int. Cl.[5] ..... B63B 21/26

[52] U.S. Cl. ..... 114/301

[58] Field of Search ..... 114/294, 297, 298, 301–310

[56] References Cited

U.S. PATENT DOCUMENTS

| | | | |
|---|---|---|---|
| 4,397,256 | 8/1983 | Bruce | 114/301 |
| 4,802,434 | 2/1989 | Bruce | 114/301 |
| 4,856,451 | 8/1989 | Bruce | 114/304 |

*Primary Examiner*—Joseph F. Peters, Jr.
*Assistant Examiner*—Jesûs D. Sotelo
*Attorney, Agent, or Firm*—Ladas & Parry

[57] ABSTRACT

An anchor comprising a fluke and a shank assembly, the latter including at one end, located at the front of the anchor, an element for attaching an anchor cable and being joined to the fluke at the other end, the fluke extending along a major plane and the shank assembly comprising two substantially elongated plate-shaped shank members which are joined at the one end and define inbetween a passage for anchor soil, wherein at least one element connecting the two shank members has been arranged in the passage. In order to improve the anchor's rigidity, the connecting elements each comprise one pair of crossing connecting parts, each part extending from the one shank member to the other shank member and comprising two portions arranged on either side of the point where the connecting parts cross. Also the passage for anchor soil through the anchor has been enhanced.

11 Claims, 2 Drawing Sheets

A

ANCHOR WITH CROSS CONNECTION

The invention relates to an anchor, comprising a fluke and a shank assembly, the latter including at one end, located at the front of said anchor, means for attaching an anchor line and being joined to said fluke at the other end, said fluke extending along a major plane and said shank assembly comprising two substantially elongated plate-shaped shank members which are joined at said one end and define inbetween a passage for anchor soil, wherein at least one means connecting said two shank members has been arranged in said passage.

A similar anchor is known from French patent specification no. 2082722. The anchor disclosed therein comprises two parallel, plate-shaped shank members, which at their one end are connected by a transverse box, and at their other end are connected to a cylinder segment-shaped fluke. In this arrangement, the cords of successive circle segment-shaped cross-sections of the fluke determine the major plane of the fluke. Between the fluke and the transverse box, two elongated cross-pieces connecting the shank members are disposed, each abutting at one longitudinal side a plate that extends approximately parallel to the major plane of the fluke, which plates each serve as an auxiliary fluke. The cross-pieces, the fluke and the transverse box are all perpendicular to the shank members, so that the construction of the shank corresponds to that of a rectangular frame.

When pulling an anchor free from the sea bottom or the like, a chain gripping means is often applied, which is connected to an anchor vessel by means of a line. In order to have the chain gripping means grip the chain of the anchor that is to be pulled free, the anchor vessel will steer a course that intersects the anchor chain. After it has been confirmed that the chain gripping means has engaged the anchor chain, the anchor vessel will usually reduce speed and return, so as to begin to pull the anchor free and haul it in. However, it often occurs that it is only noticed at a late stage, and sometimes not at all, that the chain gripper means has come into engagement with the anchor chain. As a consequence, a considerable force is exerted on the anchor chain, and also, if engagement with the anchor chain took place near the anchor, a considerable transverse force, in a direction perpendicular to the passage and parallel to the fluke, is exerted on the shank. If the shank assembly, as stated hereabove, has the shape of a rectangular frame construction, the resistance against displacement may appear to be insufficient when such a transverse force is exerted, so that the shank assembly may become permanently deformed.

It is the object of the invention to provide an anchor of the type referred to in the introduction, of which the shank assembly has improved strength in a direction transverse to the shank members and the passage and parallel to the fluke.

This object is attained in that the connecting means each comprise one pair of crossing connecting parts, extending from the one shank member to the other shank member and comprising two portions arranged on either side of the crossing.

On account of the crossing connecting parts, a type of cross connection is obtained that may provide a considerable rigidity of the shank assembly in the transverse direction. Upon engagement of a transverse force on the one shank end, the two connecting parts between the shank members are subjected to a tensile or compressive stress, respectively. This considerably impedes any mutual displacement of the two connecting points of each respective connecting part with the shank members, whereas in a rectangular frame construction the diagonally facing connecting points, being in this case part of two different connecting parts, can be moved towards and away from one another, respectively, if a transverse force engages the one end of the shank assembly.

The connecting parts are preferably connected at their crossings, thus reducing the length of the connecting part apt to buckle when subjected to compressive strength, so that the part in question can be of slighter cross-section. In order to further reduce the buckling length, the connecting parts may be rigidly connected at their crossings. Then to a large extent the position of the crossing is fixed with respect to the two shank members, thus further increasing the resistance against deformation.

According to a preferred embodiment, the connecting parts are plate-shaped, so that if a certain desired strength is maintained, the surface that is directed oppositely to the direction of the soil flow upon penetration of the anchor into the anchor soil can be kept to a minimum.

The portions of the plate-shaped connecting parts can either be substantially parallel to the major plane of the fluke, or define such an angle to the major plane of the fluke that the portions of the connecting parts forwardly converge with the major plane of the fluke, viewed in either case in a sectional plane that is parallel to the plane of symmetry of the anchor. With the latter positioning of the portions of the connecting parts, converging with respect to the major plane of the fluke, the penetration characteristics of the anchor can be improved. It is remarked that the term plane of symmetry of the anchor as used in the present description, should be understood to refer to the plane of symmetry of the anchor without the presence of one or more connecting means connecting the shank members between the one end and the other end of the shank assembly. This has been done in view of possible not precisely symmetrical positioning of the connecting parts according to the invention.

As stated hereabove, each connecting part comprises two portions. These portions may have been formed integrally, in which case the connecting part in question is devised as continuous. However, the connecting part may also consist of two portions that are connected at the crossing. In the latter case, of e.g. each pair of connecting parts, the portions located above the crossing, i.e. extending beyond the crossing as from the major plane of the fluke, may define an angle, deviating from 180°, to the portions included in the connecting parts in question below the crossing. If the connecting parts are plate-shaped, the portions disposed above the crossing, through their planes may define a different angle with respect to the major plane of the fluke than the portions disposed below the crossing, as viewed in a sectional plane parallel to the plane of symmetry of the anchor. In this way way it can be ensured that each portion of the passage in the shank assembly, co-defined by the portions of the connecting parts, is defined so, that its cross-section across the (relative) soil flow increases in the direction of the soil flow. This may be advantageous if the soil that is to be penetrated by the anchor contains granular material, on account of occurring dilatation phenomena.

According to another preferred embodiment, the corresponding fastening points on the shank members of the two plate-shaped connecting parts connected at the crossing, are coplanar in one respective plane that is perpendicular to the the plane of symmetry of the anchor, the portions of the connecting parts at least partly overlapping one another for a substantial part of their length in a projection perpendicular to the major plane of the fluke, and the one connecting part of each pair is bent forwardly at its crossing and the other connecting part is bent rearwardly at its crossing so that the connecting parts in a pair are inversely V-shaped. The condition that the corresponding fastening points of the two plate-shaped connecting parts on the shank members are coplanar, is meant to indicate that the fastening points of the connecting parts on the shank members disposed closest to the front of the anchor are coplanar, and the fastening points of the connecting parts on the shank members disposed at a maximum distance from the front of the anchor are also coplanar, which can also be said of the points disposed inbetween. The sketched bend of the connecting parts can prevent to a great extent that in the present anchor embodiment any impediment of the (relative) soil flow might occur between the portions of the connecting parts disposed on either side of the plane of symmetry of the anchor. This obstruction is caused by the fact that due to the local constriction, caused by the presence of the plate-shaped connecting parts, so-called bridging may occur in the material that is disposed between superposed portions of respective connecting parts. The effect of such a bridge can be compared to that of an arch in a building, which comparison is to indicate that the soil flow is completely obstructed at that location, until further penetration of the anchor has caused such a pressure build-up that the arch gives in. The above-mentioned measure according to the invention can prevent this bridging to a considerable extent on account of the fact that this measure causes the respective cross-sections of the portions of the connecting parts as viewed in a sectional plane that is parallel to the plane of symmetry of the anchor, are shifted with respect to one another in a direction parallel to the major plane of the fluke as well as to the plane of symmetry of the anchor (i.e. in the direction towards the front of the anchor).

Dependent on the required transverse rigidity, a number of pairs of crossing connecting parts may be disposed in the passage, crossings of which are aligned.

According to the invention, the application of a cross connection to a shaft assembly has the additional advantage that on account of the cross shape of the transverse bracing, the passage portion formed between the portions disposed closest to the fluke of the pair of connecting parts disposed closest to the fluke, the shank members and the fluke may have a larger cross-section than a corresponding passage portion with connecting parts that have been arranged perpendicular to the shank members, as with the anchor according to French patent specification 2082722. This is even more advantageous if the shank assembly has a substantially "crank-shaped" appearance, in which case each shank member can be considered to have been constructed of a top and a bottom part, the bottom part being at a larger angle to the major plane of the fluke than the top part, as viewed in perpendicular projection in a plane parallel to the plane of symmetry of the anchor. The crank-shaped appearance may have been defined at the edge of each shank member facing the front of the anchor (front edge) as well as on the edge facing away from the front of the anchor (rear edge). If the front edge is crank-shaped, then the initial penetration characteristics of the anchor are improved. By giving the anchor of the invention such an embodiment that of each pair of connecting parts provided, the crossing is at a distance from the fluke that is equal to or larger than the distance to the fluke from the junction between the bottom part and the top part of the shank, one can ensure, while maintaining the transverse bracing of the shank assembly, that during the initial penetration of the anchor the soil can easily (relatively speaking) flow through the bottom portion of the shank assembly. This even further improves the initial penetration properties of the anchor. Moreover, the enlarged passage in the bottom portion of the shank assembly allows rocks of larger dimensions to pass through.

According to another preferred embodiment of the anchor according to the invention, the shank members together define an angle so that they converge forwardly as viewed in a sectional plane that is substantially parallel to the major plane of the fluke. This measure too helps compensate for the dilatation phenomena stated before. Apart from that the shank members together may define an angle so that they converge away from the fluke as viewed in a plane of projection that is substantially perpendicular to the plane of symmetry of the anchor and to the major plane of the fluke.

When the text of the present application refers to crossings, the intersection (crossing) is meant in the case of intersecting connecting parts of a pair, and the points of the two connecting parts in question that coincide in a perpendicular projection, in a plane perpendicular both to the plane of symmetry and to the major plane of the fluke, are meant in the case of non-intersecting connecting parts of a pair.

The invention will be further elucidated hereinafter on the basis of preferred embodiments that merely serve as examples, and that are shown in the accompanying drawings, in which.

Figures 1, 4:
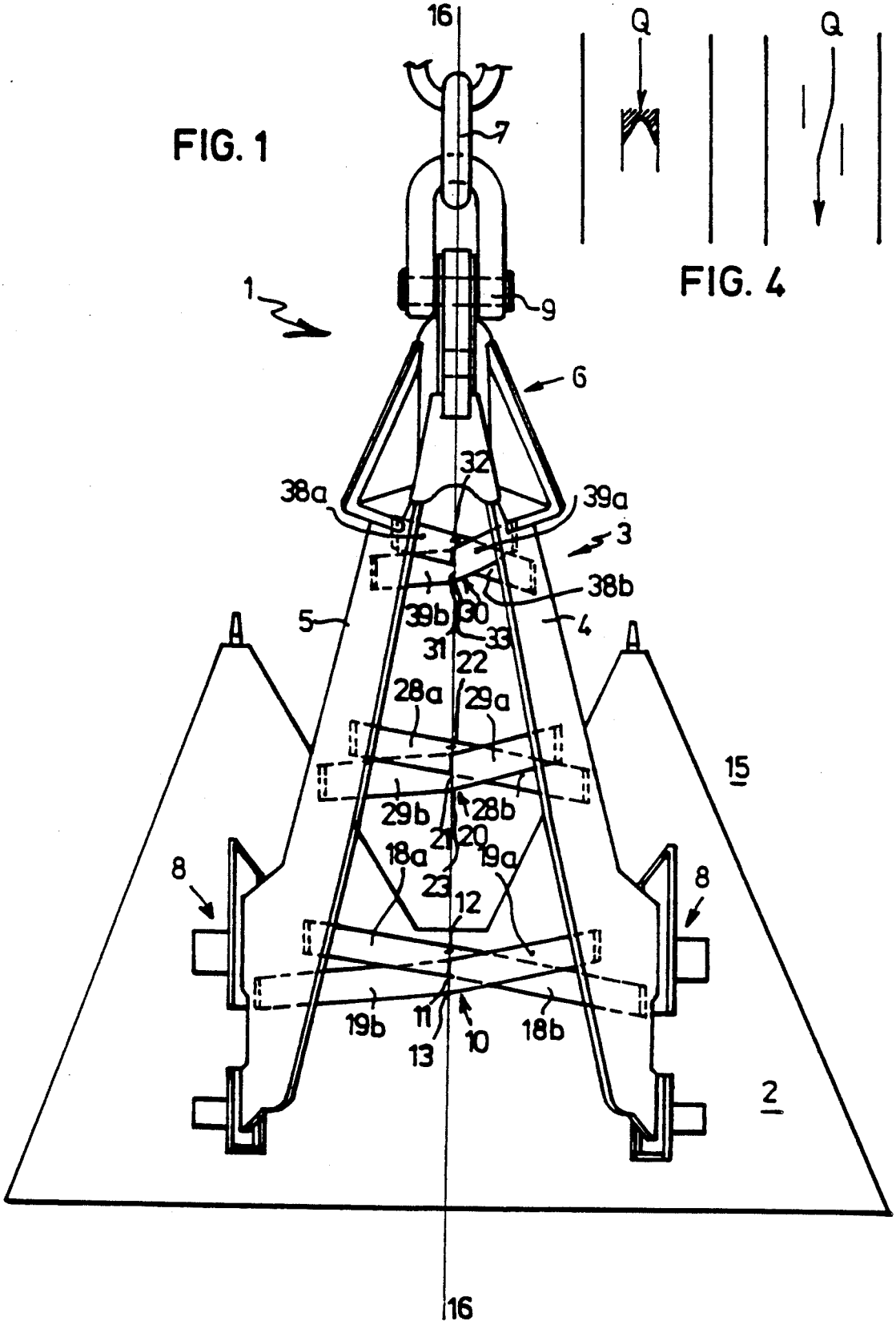
FIG. 1 is a plan view of the anchor according to a first preferred embodiment.
FIG. 4 is a pair of sketches, representing a situation in which bridging has occurred and a situation in which bridging has been prevented, respectively.
Figures 2, 3:
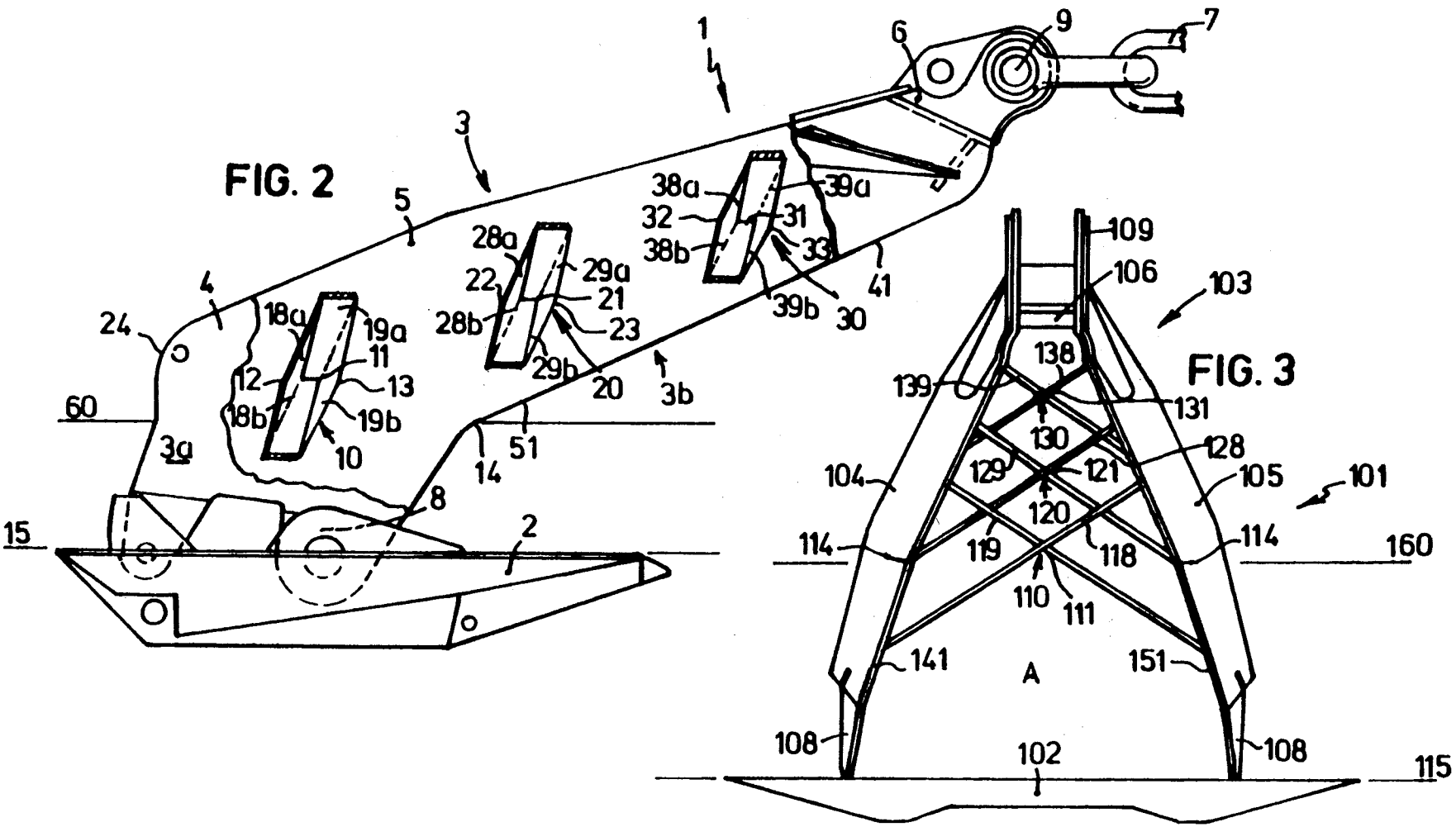
FIG. 2 is an elevational view of the anchor according to FIG. 1, partially opened up and partically sectional.
FIG. 3 is a schematic view from the front of an anchor according to a second preferred embodiment of the invention to its rear.

FIG. 1 represents an anchor 1 according to the invention, comprising a fluke 2 and a shank 3. The shank 3 is provided at its one end 6 with means 9 for attaching the shank to an anchor cable 7, and at its other end 8 with means for joining the shank 3 to the fluke 2. The shank 3 comprises two plate-shaped shank members 4 and 5. The shank members 4 and 5 are disposed in planes of which the intersecting lines with the major plane 15 of the fluke 2 represented in FIG. 2 are parallel. The passage defined by the fluke 2 and the two shank members 4 and 5 for the soil that upon penetration of the anchor into the soil passes through the shank from the top to the bottom as viewed in the drawing, does therefore neither increase nor decrease in the direction of the soil flow. Reference numeral 16 has been used to indicate the intersecting line of the plane of symmetry of the anchor 1 without the connecting parts in the shank that are to be elucidated hereinafter, the plane of symmetry extending perpendicular to the plane of the drawing. In this respect it is remarked that the major plane 15 of the fluke 2 as shown in FIG. 2 extends parallel to the plane of the drawing in FIG. 1.

The shank 3 comprises 3 pairs 10, 20 and 30 of connecting parts 18, 28, 38, 19, 29, 39 crossing at crossings 11, 21, 31 and e.g. being connected there by means of welded joints. The crossings 11, 21, 31 are all disposed in the plane of symmetry 16 and the fastening locations of the connecting parts 18 and 19, 28 and 29, 38 and 39 on the shank members are disposed mirror-symmetrical with respect to the plane of symmetry 16. Each connecting part 18, 28, 38 comprises an a-portion and a b-portion and each connecting part 19, 29, 39 comprises an a-portion and a b-portion. The portions 18*a*, 28*a*, 38*a* and 19*a*, 29*a*, 39*a*, respectively, merge at the location of the crossings 11, 21, 31 into the portions 18*b*, 28*b*, 38*b* and 19*b*, 29*b*, 39*b*, respectively. The connecting parts 18, 28, 39 and 19, 29, 39 are plate-shaped and are each disposed entirely in a respective plane. It can be seen in FIG. 1 that the fastening points of the portions 18*b*, 28*b*, 38*b* and 19*b*, 29*b*, 39*b* on the shank member 5 and the shank member 4, respectively, are disposed closer to the front of the anchor 1 than the fastening points of the portions 18*b*, 28*b*, 38*b* and 19*b*, 29*b*, 39*b* on the shank member 4 and the shank member 5, respectively. It can be seen that the connecting parts 18, 28, 38 and 19, 29, 39 do not extend in a straight line from the one fastening point to the other on the respective shank members 4 and 5, but that they are buckled at the location of the crossings 11, 21, 31. The connecting parts 18, 28, 38 are buckled rearwardly with respect to the front of the achor at the buckling point 12, 22, 32, respectively, and the connecting parts 19, 29, 39 are buckled forwardly with respect to the front of the anchor at the buckling points 13, 23, 33. The precise effect of this measure shall be further elucidated hereinafter, but it already appears from FIG. 1 that both the portions 18*a*, 28*a*, 38*a* and 19*a*, 29*a*, 39*a* are shifted with respect to one another in a direction parallel to the plane of symmetry 16, and also the portions 18*b*, 28*b*, 38*b* and 19*b*, 29*b*, 39*b*. The same is true for the mutual relations between the portions 18*a*, 28*a*, 38*a* and 19*b*, 29*b*, 39*b* and the portions 19*a*, 29*a*, 39*a* and 18*b*, 28*b*, 38*b*.

FIG. 2 shows the anchor 1 of FIG. 1 in side view, while a portion of the shank member 4 has been removed. At the location of the removed portion, thus the shank member 5 can be seen. Again the one end 6 of the shank 3 is shown, comprising means 9 for attaching the anchor 1 to the anchor cable 7. At the other end 8 of the shank 3, the shank is again connected to the fluke 2, the intersecting line of the major plane 15 of the fluke with the plane of drawing being represented. In this respect it is remarked that the plane of drawing of FIG. 2 is parallel to the plane of symmetry 16 of the anchor 1. The connecting parts 18, 28, 38 and 19, 29, 39 of the pairs of connecting parts 10, 20 and 30 are also represented, and the section of each connecting part along a plane that is parallel to the plane of symmetry 16 of the anchor and in the vicinity of the respective fastening points on the shank member 4 is shown. It can be seen here that the connecting parts in the cross-sections extend parallel to one another, and also parallel to the major plane 15 of the fluke 2.

The pairs of connecting parts 10, 20 and 30 are arranged so, that the connecting parts in their longitudinal directions are at a small angle to a plane that is perpendicular to the major plane 15 of the fluke 2 and to the plane of symmetry 16. In this way, the length of each connecting part is limited, and the rigidity of the shank assembly is enhanced with respect to moments exerted in a plane that is perpendicular to the major plane 15 of the fluke and to the plane of symmetry 16. It can also be seen in FIG. 2 that the fastening points of the portions 18*a*, 28*a*, 38*a* and 19*a*, 29*a*, 39*a*, and 18*b*, 28*b*, 38*b*, 19*b*, 29*b*, 39*b*, respectively on the shank members are forwardly displaced with respect to one another. This arrangement enhances the rigidity of the shank with respect to moments that occur in a plane that is parallel to the major plane 15 of the fluke 2. This also creates a situation in which the portions 18*a*, 28*a*, 38*a* and 19*a*, 29*a*, 39*a* are shifted forwardly with respect to the portions 19*b*, 29*b*, 39*b* and 18*b*, 28*b*, 38*b*. To a limited extent, this helps to prevent bridging of the soil flowing (relatively speaking) through the shank at the location of the passages that are formed by the portions 18*a*, 28*a*, 38*a* and 19*b*, 29*b*, 39*b* and the shank leg 4, and the portions 19*a*, 29*a*, 39*a* and 18*b*, 28*b*, 38*b* and the shank leg 5, respectively. Bridging in said passages can be prevented to a large extent by providing the connecting parts with a buckle, as discussed above in the description of FIG. 1. In this arrangement the connecting part 18, 28, 38 is V-shaped, the point 13, 23, 33 being directed forwardly with respect to the anchor 1, and the connecting part 19, 29, 39 is V-shaped, the point 13, 23, 33 being directed rearwardly with respect to anchor 1. The effect of such an arrangement is that at the point where the portions 18*a*, 28*a*, 38*a* and 19*b*, 29*b*, 39*b* and 18*b*, 28*b*, 38*b* and 19*a*, 29*a*, 39*a* approach one another, i.e. towards the crossing 11, 21, 31, the mutual displacement with respect to the anchor 1 increases forwardly.

The bridging phenomenon has been further elucidated in the lefthand sketch in FIG. 4. Two schematically shown parallel plates are at equal level with respect to the soil flow Q. In this case the soil between the plates may form a pressure arch, providing resistance to the soil flow Q. The right-hand sketch shows how this bridging phenomenon is prevented in the cross connection according to the invention. The two parallel plates are now shifted with respect to one another in the direction of the soil flow Q, so that the soil is no longer able to form a pressure arch.

It is remarked that the plate-shaped connecting parts of a pair, as viewed in a sectional plane that is parallel to the plane of symmetry 16, are able to converge forwardly with the major plane 15 of the fluke and also with the connecting parts of possible other pairs with respect to the anchor. This is also true for the mutual relation of the portions 18*a*, 28*a*, 38*a* and 19*b*, 29*b*, 39*b* with the portions 28*b*, 28*b*, 38*b* and 19*a*, 29*a*, 39*a* of each pair of connecting means. In this case the connecting parts are each situated in two planes that comprise the respective portions.

It can also be seen in FIG. 2 that the shank has a substantially crank-shaped appearance. The edge of each shank member 4, 5 facing away from the front of the anchor is bent at curve 24. The edge 41, 51 of each shank member 4, 5 facing towards the front of the anchor is bent at curve 14. Thus the shank can be considered to have been constructed from a bottom portion 3*a*, comprising the other end 8, and a top portion 3*b*, comprising the one end 6. The bottom portion 3 defines a larger angle with the major plane 15 of the fluke 2 than the top portion 3*b* with the major plane 15. The bent or buckled shape of the edges 41, 51 of the shank member 4, 5 facing towards the front of the anchor are advantageous to the initial penetration characteristics of the anchor 1, in tougher soil types. It can be seen in FIG. 2 that the crossing 11 of the pair 10 of connecting parts 18 and 19, which pair is disposed closest to the major plane 15 of the fluke 2, is located further away from the major plane 15 than the line 60, extending parallel to the major plane and comprising the curve 14. The portions 18*b* and 19*b* of the pair 10 of connecting parts are fastened onto the shank legs 4 and 5 at a location that is located within the bottom portion 3*a* of the shank. Thus a sufficient rigidity of the shank in the bottom portion 3*a* and the adjacent portion of the top portion 3*b* can be provided against the transverse forces exerted on the one end 6 in a direction perpendicular to the plane of drawing of FIG. 2, while a large passage is provided at the same time, which passage is defined by the fluke 2, by the portions of the shank legs 4 and 5 disposed in the bottom portion 3*a* of the shank 3 and by the portions 18*b* and 19*b* of the pair 10 of connecting parts, by means of which the soil can be rapidly discharged during the initial penetration of the anchor. Moreover, larger pieces of soil, such as rocks, can now pass through the anchor, in particular the bottom portion 3*a*, and therefore the anchor will less easily get obstructed during penetration.

FIG. 3 schematically shows another preferred embodiment of the anchor according to the invention. It shows a shank 103 with one end 106, comprising attaching means 109 for attachment to an anchor cable (not shown), and another end 108, comprising joining means for joining it to fluke 102. The shank 103 furthermore comprises two shank members 104 and 105. As can be seen, the shank members 104 and 105 converge, as was the case with the anchor 1 of FIGS. 1 and 2, away from fluke 102, i.e. in a direction perpendicular to the major plane 115 of fluke 102, of which major plane the intersecting line with the plane of drawing has been represented. This anchor 101 is distinct from the anchor 1 of FIGS. 1 and 2 in that the planes in which the plate-shaped shank members 104 and 105 are disposed also converge towards the front of the anchor, i.e. that the cross-sections of the shank members 104 and 105 with a plane that is parallel to the major plane 115 converge towards the front of the anchor, in this case from the plane of drawing in FIG. 3 upwards. Such a shape of shank 103 offers advantages in view of dilatation phenomena of the anchor soil passing through the passage, and also improved penetration characteristics on account of a type of ploughing effect of the planes of the shank members 104 and 105 now facing towards the front of the anchor.

In FIG. 3 a set of three pairs 110, 120, 130 of connecting parts 118, 128, 138 and 119, 129, 139 are arranged in the shank 103. The connecting parts 118, 128, 138 and 119, 129, 139 intersect at the crossings 11, 121, 131, respectively. Contrary to what FIG. 3 suggests, the pairs 110, 120, 130 do not intersect. The mutual positioning of the connecting parts with respect to one another, both within a pair with respect to one another and with respect to corresponding connecting parts of other pairs, can be substantially identical to the positioning as discussed with respect to FIGS. 1 and 2. One can see the curves 114 of the edges 141, 151 of the shank members 104 and 105 facing towards the front of the anchor. The edges 141, 151 in question have a shape that substantially corresponds to that of the corresponding edges 41, 51 of the anchor 1 represented in FIGS. 1 and 2. Reference numeral 60 has been used to refer to a plane that comprises the two curves 114 and that extends parallel to the major plane 115 of the fluke 102. It can be seen that the crossing 111 of the pair 110 of connecting parts is at a distance from the major plane 115 of the fluke 102 that is larger than the distance from the major plane 115 to the plane 160. In this front view of the anchor 101 it can be clearly seen that a large passage A for soil is provided in the portion of the shank 103 adjacent the fluke 102.

One has to bear in mind that the represented examplary embodiments merely serve as examples and that they are not meant to restrict the scope of the invention as defined by the accompanying claims. The connecting parts may e.g. have any suitable shape in their cross-section and the shank members may each be plate-shaped, and also they may have been disposed in a plurality of planes. The two shank members may also have been disposed in planes that are entirely parallel to one another.

I claim:

1. An anchor comprising a fluke and a shank assembly, the latter including at one end, located at the front of said anchor, means for attaching an anchor cable and being joined to said fluke at the other end, said fluke extending along a major plane and said shank assembly comprising two substantially elongated plate-shaped shank members which are joined at said one end and define inbetween a passage for anchor soil, wherein at least one means connecting said two shank members has been arranged in said passage, characterized in that said connecting means (10, 20, 30) each comprise one pair of crossing connecting parts (18, 19; 28, 29; 38, 39), each part extending from the one shank member (4) to the other shank member (5) and comprising two portions (18*a*, 18*b*; 19*a*, 19*b*; 28*a*, 28*b*; 29*a*, 29*b*; 38*a*, 38*b*; 39*a*, 39*b*) arranged on either side of the point (11; 21; 31) where the connecting parts cross.

2. An anchor as claimed in claim 1, characterized in that the connecting parts (18, 19; 28, 29; 38, 39) are joined at their respective crossings (11; 21; 31).

3. An anchor as claimed in claim 2, characterized in that the connecting parts (18, 19; 28, 29; 38, 39) are rigidly joined at their respective crossings (11; 21; 31).

4. An anchor as claimed in claim 1, characterized in that the connecting parts (18, 19; 28, 29; 38, 39) are plate-shaped.

5. An anchor as claimed in claim 4, characterized in that said portions (18*a*, 18*b*; 19*a*, 19*b*; 28*a*, 28*b*; 29*a*, 29*b*; 38*a*, 38*b*; 39*a*, 39*b*) of the connecting parts (18, 19; 28, 29; 38, 39) are substantially parallel to said major plane of the fluke, as viewed in a sectional plane that is parallel to the plane of symmetry (16) of said anchor (1).

6. An anchor as claimed in claim 4, characterized in that the portions (18*a*, 18*b*; 19*a*, 19*b*; 28*a*, 28*b*; 29*a*, 29*b*; 38*a*, 38*b*; 39*a*, 39*b*) of the connecting parts (18, 19; 28, 29; 38, 39) and the major plane (15) of the fluke (2) define an angle so that the connecting parts forwardly converge with the major plane of the fluke, as viewed in a sectional plane that is parallel to the plane of symmetry (16) of the anchor (1).

7. An anchor as claimed in claim 4, characterized in that corresponding fastening points on the respective shank members (4, 5) of the two connecting parts (18, 19; 28, 29; 38, 39) in each pair (10; 20; 30), respectively, are coplanar in one specific plane that is perpendicular to the plane of symmetry (16), the portions of the connecting parts at least partly overlapping one another for a substantial part of their length in a projection perpendicular to the major plane of the fluke (2), and in that the one connecting part (18, 19; 28, 29; 38, 39) of each pair (10; 20; 30) is bent forwardly at its crossing (11; 21; 31) and the other connecting part (18, 19; 29, 28; 38, 39) is bent rearwardly at its crossing (11; 21; 31) so that the connecting parts in a pair are inversely V-shaped.

8. An anchor as claimed in claim 1, characterized in that in the passage a plurality of pairs (10; 20; 30) of crossing connecting parts are arranged, the crossings (11; 21; 31) of which are aligned.

9. An anchor as claimed in claim 1, wherein the forward edge of each shank member comprises two trajectories that substantially meet in an inside curve and that define an angle thus shaping a bend in the edge of the respective shank member, viewed in perpendicular projection in a plane parallel to the plane of symmetry of the anchor, the trajectory adjacent the fluke being at a steeper angle with the major plane than the adjoining trajectory, characterized in that each of the crossings (11; 21; 31) is at a distance of the major plane (15) of the fluke (2) that is equal to or larger than the distance of the inside curve (14) in the edge (41) of the respective shank member (4; 5) to said major plane (15).

10. An anchor as claimed in claim 1, characterized in that the shank members (4; 5) together define an angle so that they converge forwardly as viewed in a sectional plane that is substantially parallel to the major plane (15) of the fluke (2).

11. An anchor as claimed in claim 1, characterized in that the shank members (4; 5) together define an angle so that they converge away from the fluke (102) as viewed in a plane of projection that is substantially perpendicular to the plane of symmetry of anchor (101) and to the major plane (115) of the fluke (102).

* * * * *